United States Patent [19]

Cellerini et al.

[11] 4,162,467

[45] Jul. 24, 1979

[54] CIRCUIT BREAKER CONTACT STRUCTURE

[75] Inventors: Albert R. Cellerini; Louis N. Ricci; James O. Rexroad, all of Beaver, Pa.

[73] Assignee: Westinghouse Electric Corp., Pittsburgh, Pa.

[21] Appl. No.: 806,969

[22] Filed: Jun. 16, 1977

[51] Int. Cl.[2] ..... H01H 75/10

[52] U.S. Cl. ..... 335/16; 335/195

[58] Field of Search ..... 335/16, 195, 147

[56] References Cited

U.S. PATENT DOCUMENTS 3,735,075 5/1973 Kidd ..... 335/195

*Primary Examiner*—George Harris

*Attorney, Agent, or Firm*—L. P. Johns

[57] ABSTRACT

A circuit interrupter with improved current withstand capability characterized by stationary and movable contact means, the stationary contact means comprising first and second conductors being substantially parallel and having an air gap therebetween, the first conductor being pivotally mounted on the second conductor and being in the zone of pivotal movement of the first conductor so that when a fault current of predetermined conditions occurs a magnetic flux between the first and second conductors urges the first conductor toward the movable contact means.

6 Claims, 3 Drawing Figures

CIRCUIT BREAKER CONTACT STRUCTURE

BACKGROUND OF THE INVENTION

1. Field of the Invention

This invention relates to circuit interrupters, and more particularly, it pertains to a circuit breaker having an increased current withstand capability to give downstream branch circuit breakers a chance to open first and thereby possibly prevent the main circuit breaker from opening.

2. Description of the Prior Art

It is well known that the disposition of the stationary and moving contacts of circuit breakers is such that forces generated by a short circuit tend to blow the contacts apart. This happens immediately upon the occurrence of a short circuit and before the breaker mechanism can unlatch and open the contacts. The disadvantage of such occurrences is extensive damage to the contacts.

SUMMARY OF THE INVENTION

In accordance with this invention it has been found that the foregoing disadvantage may be overcome by providing a circuit interrupter having improved current withstand capability and comprising stationary contact means and movable contact means movable between open and closed positions, terminal conductor means comprising first and second terminals, the stationary contact means comprising first and second conductors being substantially parallel and having an air gap therebetween, the movable contact means being connected to the first terminal and the second conductor being connected to the second terminal, the first conductor being pivotally mounted on the second conductor, the second conductor being in the plane of pivotal movement of the first conductor, the pivotal mounting comprising interfitting contact surfaces, bias means comprising a coil spring between the first and second conductors and at an angle so as to provide one vector force on the first conductor toward the movable contact means and another vector force on the first conductor towards the pivotal mounting, limit means for limiting the movement of the first conductor toward the movable contact means, the movable contact means comprising a movable contact carrying arm, a first movable contact button on the arm and engageable with a corresponding stationary contact button on the first conductor, a second movable contact button on the arm and engageable with conductor means connected to the second conductor, the first movable contact button being separable from said stationary contact button before separation of the second movable contact from said conductor means, the current path through the interrupter being from the first terminal and through the movable contact means, the first conductor, the second conductor, and then to the second terminal so that when a fault-current of minimal predetermined conditions occurs a magnetic flux occurs between the first and second conductors sufficient to urge the first conductor toward the movable contact means.

The advantage of the circuit interrupter of this invention is that it provides means for overcoming premature separation of the contacts and thereby minimizes arcing between the contact buttons.

DESCRIPTION OF THE PREFERRED EMBODIMENT

Figure 1:
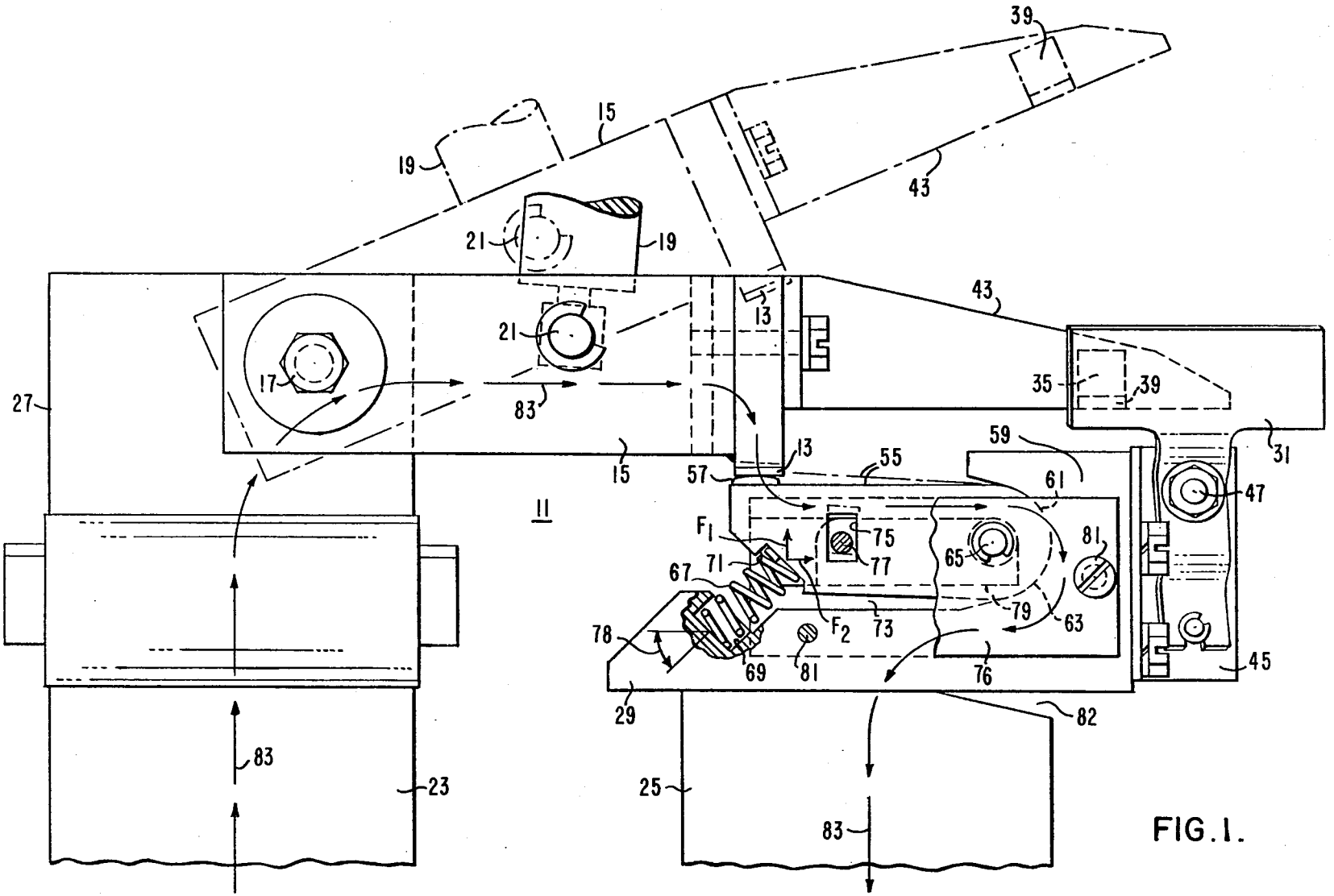
FIG. 1 is a side elevational view of the operating mechanism of a circuit interrupter showing the interrupter in the closed circuit position.

In FIG. 1 a circuit breaker operating mechanism is generally indicated at 11 and is generally similar in construction and operation to that disclosed in U.S. Pat. Nos. 3,343,042, 3,904,998, and 3,869,192, which are incorporated as part hereof and for which reason only a limited description is included herewith. Briefly, the operating mechanism 11 is part of a three-pole circuit breaker mechanism supported within an insulating housing (not shown). The drawings disclose the operating mechanism 11 for one pole unit of the three-pole circuit breaker. It comprises movable contact means including a movable contact button 13 mounted on a carrying arm 15. The arm 15, being pivotally mounted on a pin 17 is movable between the solid and broken line positions of the arm in response to either manual operation of a handle in a conventional manner or automatic operation due to thermal magnetic tripping or electronic sensing means. Either manual or automatic operation is transmitted through a suitable operating mechanism which, among other things, comprises a toggle link 19 that is pivotally connected by a pivot pin 21 to the carrying arm 15.

Figure 3:
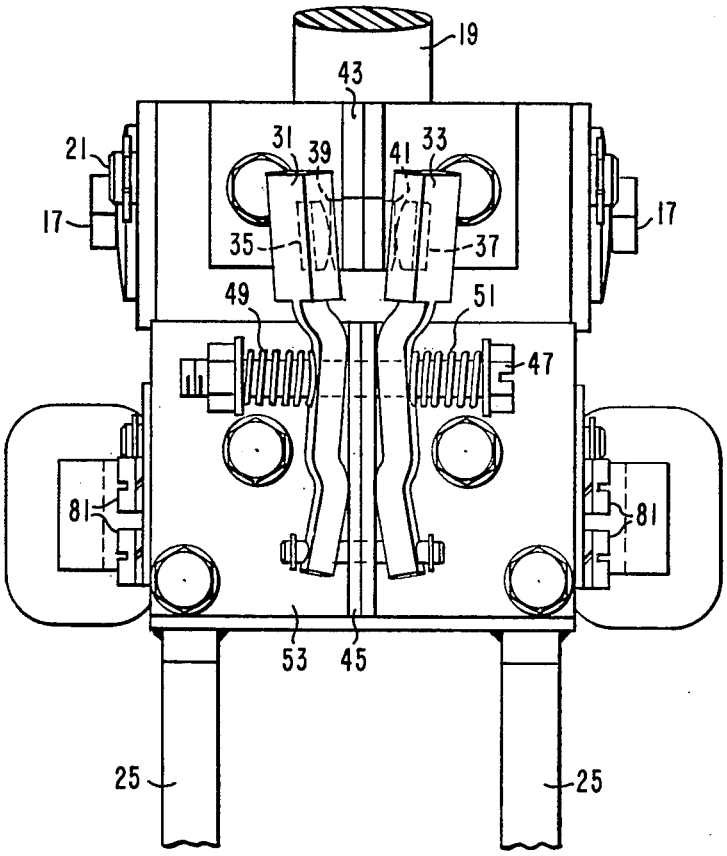
FIG. 3 is an end view of the operating mechanism of this invention.

In addition to the circuit breaker, operating mechanism 11 spaced terminal connectors, such as a line terminal 23 and a load terminal 25, extend through an insulating housing (not shown). A conductor 27 is attached to the inner end of the line terminal 23 and the carrying arm 15 is pivotally mounted thereon by the pivot pin 17. A conductor 29 is electrically connected in a suitable manner, such as by brazing, to the inner end of the load terminal 25. As shown in the drawings a pair of arc runners 31, 33, having opposed arcing contacts 35, 37 (FIG. 3), are provided for cooperation with movable arcing contacts 39, 41 on an extension 43 of the carrying arm 15. The arc runners 31, 33 are mounted on a mounting plate 45 on an elongated bolt 47 on which coil springs 49, 51 are disposed for holding the arc runners in spaced relation for accepting the contacts 39, 41 when the carrying arm 15 is in the closed position (FIG. 1). The mounting plate 45 includes a mounting flange 53 which is bolted to the end of the conductor 29 in a suitable manner for good electrical contact.

In accordance with this invention the conductor 29 cooperates with a conductor 55 which supports a stationary contact or button 57. The conductor 29 includes an upright portion 59 and comprises a semicircular surface 61 which is disposed in good electrical contact with a corresponding semicircular surface 63 of the conductor 55. Bias means such as a coil spring 67 extending between cavities 69, 71 in the conductors 29, 55 respectively, hold the conductor 55 in an elevated position to maintain a gap 73 between the conductors 29, 55. The conductor 55 comprises a slot 75 in which a pin 77 is disposed. Upward and downward movement of the conductor 55 is limited by upper and lower ends of the slots 75 by the pin.

Figure 2:
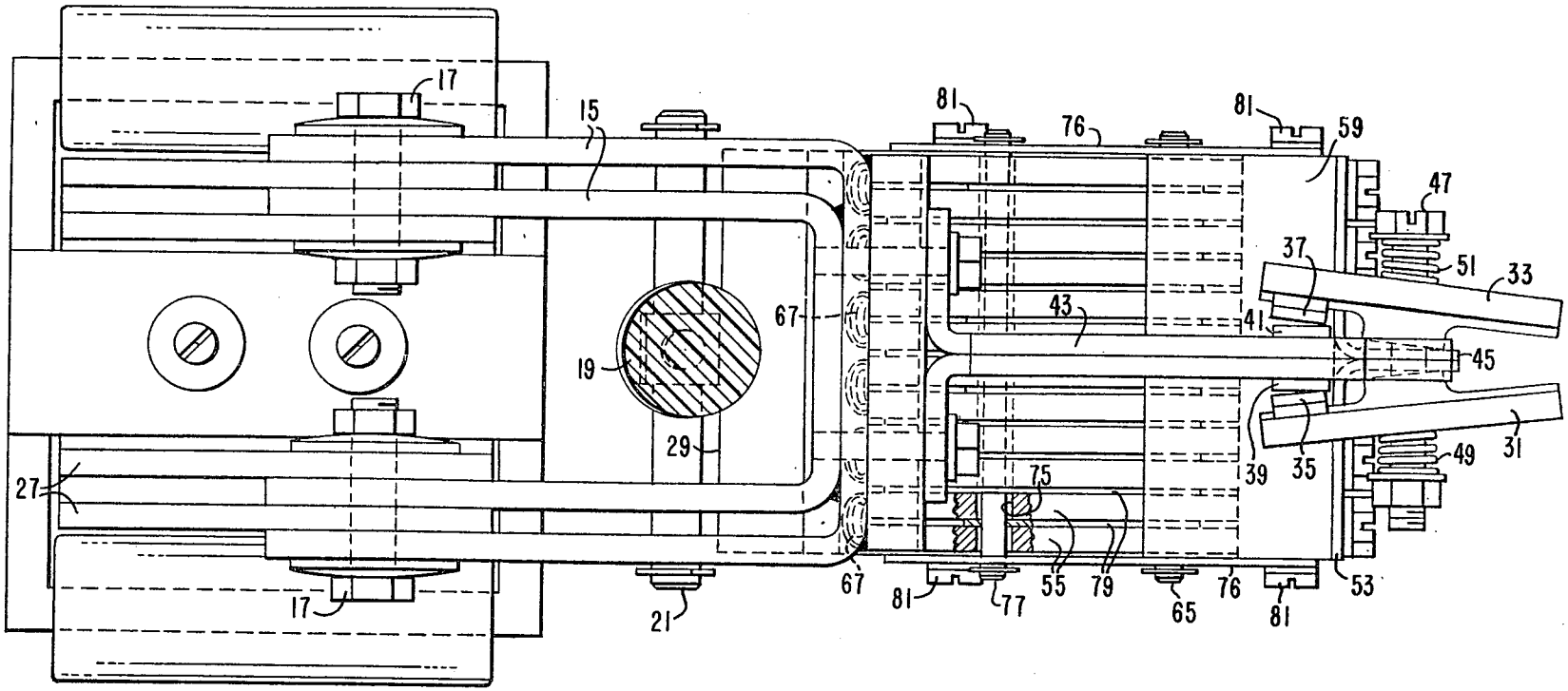
FIG. 2 is a plan view of the operating mechanism shown in FIG. 1.

The coil spring 67 is inclined at an angle 78 between the conductors 29, 55 to provide two force vectors on the conductor 55. A vertical vector, $F_1$, provides a contact pressure between the contacts 13, 57 when the carrying arm 15 moves to the closed position. A second vector, $F_2$, is a horizontal component of the spring which holds the contacting surfaces 61, 63 of the conductors 29, 55 in good electrical contact with each other. End plates 76 support the pins 65, 77 which in turn support spacers 79 between the several conductors 55 (FIG. 2). The end plates 76 spacers are retained in place by spaced bolts 81. Accordingly, the conductor 55 is rotatable in a plane corresponding to the conductor 29. The pin 65 is the center of rotation but does not see any force. Rather, the force is between the surfaces 61, 63 due to the second vector $F_2$.

The connection between the load terminal 25 and the conductor 29 extends only partially across the load terminal. The remainder of the interface between the load terminal and the conductor includes a gap 82.

During operation of the circuit breaker a current path indicated by the line 83 extends from the line terminal 23 through the conductor 27, the carrying arm 15, the contacts 13, 57, the conductors 55, 29, and the load terminal 25. In accordance with this invention the portions of the current path 83 extending through the conductors 55, 29 provide a current path loop, portions of which are parallel and sufficiently close together to create contact pressure from repulsive flux generated by the current in the conductors 29 and 55, thereby forcing the conductor 55 to move upwardly and away from the conductor 29. As a result the contacts 13, 57 are forced together and overcome a repulsive separating force normally occurring between them. Due to the gap 82 the portion of the current path in the conductor 29 must travel sufficiently along the gap 82 and parallel to the conductor 55 before it enters the load terminal 25.

Under normal operating conditions the spring 67 maintains the contacts 13, 57 in good electrical contact. If an abnormal current (of say 15,000–50,000 amperes) occurs, the repulsive flux developed between the conductors 29 and 55 is sufficient when added to the force of the spring 67 to overcome the repulsive forces between the contacts 13 and 57. In that current range the circuit interrupter withstands the abnormal current condition and a downstream branch circuit breaker may open, thereby preventing the circuit breaker operating mechanism 11 from opening the contacts 13, 57. Thus, the device of this invention allows a time delay which under many circumstances avoids the ultimate opening of the circuit breaker.

Where, however, the current overload is sufficiently high, say 100,000 amperes, the tripping means are set to trip the breaker mechanism without delay. The conductor 55 moves upwardly, or clockwise around the pin 65, and ultimately other automatic thermal, magnetic or electronic sensors trip mechanisms separate the contacts 13, 57. However, after the contacts 13, 57 separate the arcing contacts 39, 41 remain in momentary contact with the arcing contacts 35, 57 of the arc runners 31, 33, thereby preventing the contacts 13, 57 from arcing.

In conclusion, the device of this invention provides a contact structure in which the current path doubles back to exert added contact pressure, especially at higher currents, to urge the contacts together and thereby minimize arcing between them. Thus, an increased current withstand capability is provided to give downstream branch circuit breakers a chance to open first and thereby possibly prevent the main circuit breaker from opening. At low currents where magnetic pressures are practically non-existent the spring maintains the contacts in good electrical contact with each other.

What is claimed is:

1. A circuit interrupter with current withstand capability comprising stationary contact means and movable contact means movable between open and closed position, terminal conductor means comprising first and second terminals, the stationary contact means comprising first and second conductors being substantially parallel and having a gap therebetween, the movable contact means being connected to the first terminal and the second conductor being connected to the second terminal, the first conductor being pivotally mounted in the second conductor, the second conductor being in the zone of pivotal movement of the first conductor, the current path through the interrupter being from the first terminal and through the movable contact means, the first conductor, the second conductor, and then to the second terminal so that when a fault-current of minimal predetermined conditions occurs a magnetic flux occurs between the first and second conductors to urge the first conductor toward the movable contact means, and bias means for urging the first conductor toward the movable contact means.

2. The circuit interrupter of claim 1 in which the bias means comprises a spring.

3. The circuit interrupter of claim 2 in which the spring is a coil spring disposed between the first and second conductors.

4. The circuit interrupter of claim 3 in which the spring disposed at an angle so as to provide one vector force on the first conductor toward the movable contact means, and another vector force on the first conductor toward said pivotal mounting.

5. The circuit interrupter of claim 3 in which there are limit means for limiting the movement of the first conductor toward the movable contact means.

6. The circuit interrupter of claim 2 in which the movable contact means comprises a movable contact carrying arm, a first movable contact button on the arm and engageable with a corresponding stationary contact button on the first conductor, second movable contact button on the arm and engageable with conductor means connected to the second conductor, and the first movable contact button being separable from said stationary contact button before separation of the second movable contact from said conductor means.

* * * * *